US005722598A

United States Patent [19]

Werding

[11] Patent Number: 5,722,598

[45] Date of Patent: Mar. 3, 1998

[54] SPRAYING NOZZLE FOR REGULATING THE RATE OF FLOW PER UNIT OF TIME

[76] Inventor: Winfried Werding, 2, rue du Carroz, La Rippe, Switzerland

[21] Appl. No.: 553,294

[22] PCT Filed: May 20, 1994

[86] PCT No.: PCT/IB94/00118

§ 371 Date: Nov. 22, 1995

§ 102(e) Date: Nov. 22, 1995

[87] PCT Pub. No.: WO94/27729

PCT Pub. Date: Dec. 8, 1994

[30] Foreign Application Priority Data

May 25, 1993 [CH] Switzerland ..... 1561/93

[51] Int. Cl.[6] ..... B05B 7/10; B05B 1/34

[52] U.S. Cl. ..... 239/403; 239/466; 239/491

[58] Field of Search ..... 239/461, 462, 239/466, 600, 491, 492, 399, 402, 403

[56] References Cited

U.S. PATENT DOCUMENTS

| | | | |
|---|---|---|---|
| 2,284,264 | 5/1942 | Crisp | 239/466 |
| 2,660,474 | 11/1953 | Lee, II | 239/466 X |
| 2,797,134 | 6/1957 | Fuller . | |
| 2,920,831 | 1/1960 | Johnsyn | 239/466 X |
| 3,081,952 | 3/1963 | Woodward et al. | 239/466 X |
| 3,275,248 | 9/1966 | O'Brien et al. | 239/466 X |

FOREIGN PATENT DOCUMENTS

| | | |
|---|---|---|
| 0 000 688 | 2/1979 | European Pat. Off. . |
| 1 589 942 | 5/1981 | United Kingdom . |

*Primary Examiner*—Kevin Weldon
*Attorney, Agent, or Firm*—Young & Thompson

[57] ABSTRACT

A nozzle sleeve (1) contains supply channels (2), feeding channels (3, 5, 22, 24), concentric channels (4, 6), tangential channels (8) and a ring-shaped channel (7), as well as a core (13) which covers the various channels, so hermetically that they form ducts into which a liquid flows and is pushed in a predetermined direction of rotation into the large concentric channel (4), then flows in the opposite direction of rotation into the small concentric channel (6) and finally flows once again in the predetermined direction of rotation through the feeding channels (5) and reaches a ring-shaped channel (7) from where it is sprayed out through the bore (9) of the nozzle sleeve (1). The changes in the direction or rotation cause turbulences which represent a braking force for the liquid flowing under pressure. The intensity of this braking force is directly proportional to the liquid pressure, so that the rate of flow per unit of time is held at least approximately constant.

16 Claims, 3 Drawing Sheets

SPRAYING NOZZLE FOR REGULATING THE RATE OF FLOW PER UNIT OF TIME

FIELD OF THE INVENTION

The object of the present invention is a spraying nozzle for regulating the rate of flow per unit of time which consists of a nozzle sleeve and a nozzle core positioned within the nozzle sleeve. Spraying nozzles of this kind can for instance be used in mechanical spray systems such as those found in atomizing pumps or spray cans using compressed gases such as air or nitrogen or soluble gases such as $CO_2$ or $N_2O$ as their propellants, where the spraying nozzle according to the present invention will not only atomize the liquids but will also maintain the amount of liquid delivered in unit time at least approximately constant, even though the pressure decreases as the can is emptied when aforementioned gases are used.

BACKGROUND OF THE INVENTION

Recognizing the need for environmental care, indeed protection, one is led to inquire whether a large part of the solvents such as alcohols, hydrocarbons, trichloroethylene, 1,1,1-trichloroethane and others currently used might be replaced with water and merely compressed air used as the propellant, rather than liquid gases.

In spray cans with compressed air, a reduction in pressure is known to arise on account of the increase in dead volume which occurs as the can is emptied. Complex regulating mechanisms exist which will largely compensate this disadvantage, but they lead to problems in assembly line timing or defects in precision when manufactured on a large scale.

SUMMARY OF THE INVENTION

Water vaporizes but slowly when its droplets measure more than 50 microns, a size that so far can only be attained with high-precision nozzles using mechanical dispersion and regarded as being already rather fine, even though it remains above that of the droplets produced when liquid gases such as propane, butane or dimethyl ether expand as if exploding upon their contact with atmospheric pressure.

SUMMARY OF THE INVENTION

It is the task of the spraying nozzle according to the present invention, on one hand to deliver 70% of the total amount discharged in unit time with a droplet size below 40 microns, and on the other hand to minimize the drop in delivery rate occurring between the highest and lowest pressure in the can, preferably to less than 20%, which is the percentage loss found even in conventional aerosol cans with liquid gas.

According to the invention, this task is accomplished by a spraying nozzle for regulating the rate of flow per unit of time, characterized by the fact that supply channels open into first feeding channels which are arranged in one direction of rotation and feed a first concentric channel; and that at least second feeding channels which are connected to a bore issue from this first concentric channel in a direction of rotation opposite to the earlier direction of rotation.

Advantageously, the second feeding channels can be connected inwardly with at least a second concentric channel which is connected through at least third feeding channels with an inner, ring-shaped channel provided with a bore, while the feeding channels situated on opposite sides of a concentric channel run in opposite directions and at oblique angles to the radial direction.

This leads to a particularly small size of the droplets and a rate of flow that is the most constant possible.

An advantageous embodiment is characterized by the fact that the first concentric channel is a heptagon while the second concentric channel forms a pentagon; that the first concentric channel is fed via seven first feeding channels and the second concentric channel is fed via five second feeding channels; and that three third feeding channels formed as tangential channels issuing from the second concentric channel open into the ring-shaped channel.

This arrangement results in a particularly effective mode of operation and an original design.

In a variant at least the first concentric channel is provided with constrictions and, in a direction essentially perpendicular to these constrictions, with air channels connected via bores to the outside air.

A high degree of atomization is attained on account of the air drawn in from the outside through the Venturi effect.

BRIEF DESCRIPTION OF THE DRAWINGS

The object of the invention is described in detail below and illustrated with examples of embodiments which are advantageous but not limiting. The accompanying drawing shows in FIG. 1 a front view of a spraying nozzle according to the invention which is positioned within a nozzle sleeve, FIG. 2 a sectional view of the spraying nozzle of FIG. 1, FIG. 3 a sectional view of a delivery head containing a spraying nozzle according to the invention, FIG. 4 a front view of another embodiment of a spraying nozzle according to the invention, FIG. 5 a front view of a spraying nozzle according to the invention which aspires outside air, and FIG. 6 a sectional view of the spraying nozzle of FIG. 5.

DESCRIPTION OF THE PREFERRED EMBODIMENTS

Turbulent liquid flow is known to produce depression downstream, which depends on the quality of the duct walls and on the flow velocity. Moreover, owing to the formation of turbulences, angular bends produce a larger depression than radiused bends.

The velocity of a liquid flow being a function of the pressure to which the liquid is subjected, a high velocity leading to a large depression and a lower velocity leading to a smaller depression, it can be concluded that, in view of the associated depression, the "amount of liquid delivered per unit of time" resulting at high pressures (and thus high velocities) does not surpass that resulting at reduced velocity (and thus a lower pressure), therefore, a practically constant amount of liquid is delivered per unit of time despite a decrease in the pressure to which the liquid is subjected.

The spraying nozzle according to the invention is conceived in such a way that through sharp changes in the direction of flow of a liquid under pressure, on the one hand turbulences are generated which so influence the amount of liquid delivered per unit of time that it remains at least approximately constant, and on the other hand the liquid is atomized on account of an extremely intense dispersion. The surface area of the atomized liquid thus becomes larger than that exhibited by the larger droplets produced by known spraying nozzles. This larger surface area of the droplets leads to a more rapid vaporization, which is extremely important when water is used as the solvent.

Figure 1:
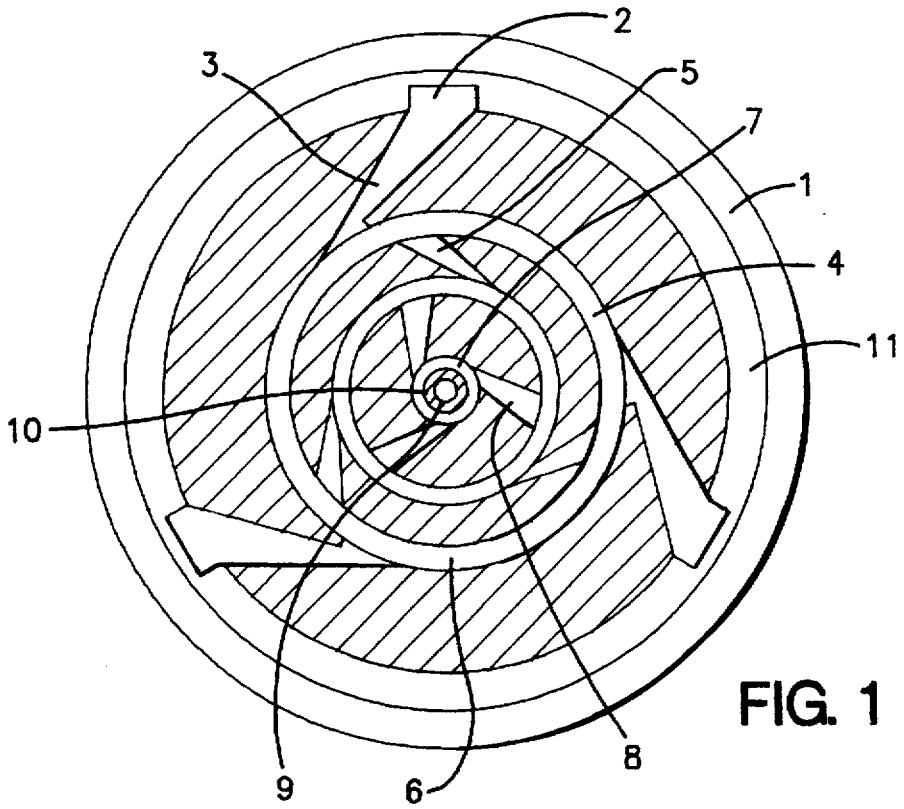
Figure 2:
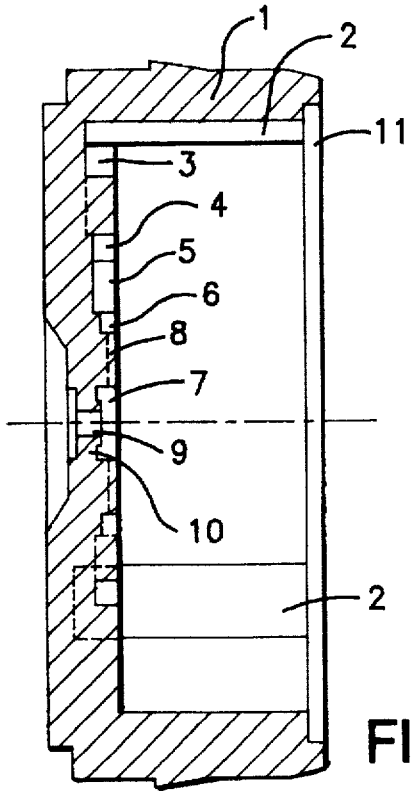

FIG. 1 shows the interior of a nozzle sleeve containing supply channels 2 through which a liquid (not shown) reaches feeding channels 3 opening into a large concentric channel 4. The feed direction of the feeding channels 3 is here selected to be counterclockwise. Issuing clockwise from the concentric channel 4, feeding channels 5 run in the direction of a small concentric channel 6. Central to the nozzle sleeve 1 is a ring-shaped channel 7 receiving, once more in a counterclockwise direction, the tangential channels 8. The bore 9 of nozzle sleeve 1 is surrounded by a bulge 10 which very favorably influences the dispersion of a liquid. The nozzle sleeve 1 is provided with a recess 11 serving to distribute a liquid (not shown) among the supply channels 2.

Figure 3:
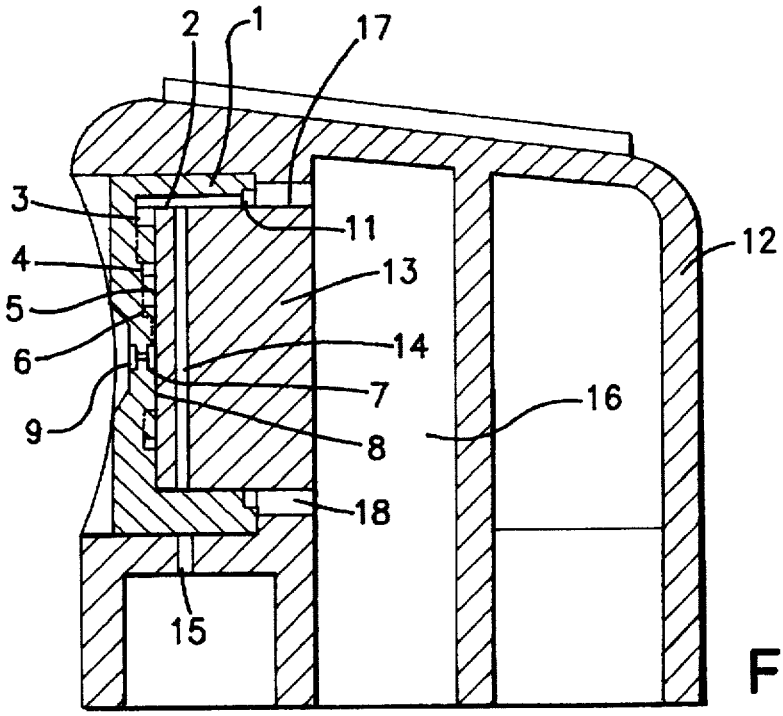

FIG. 3 shows a delivery head 12 with a core 13 positioned within the nozzle sleeve 1. The core 13 is provided with a hollow space 14 aligned with a bore 15 of the delivery head 12. It is the purpose of the hollow space 14 to avoid deformation of the front end of core 13 when the delivery head 12 is manufactured by injection molding, since the front face of core 13 must be as flat as possible in order to cover the feeding channels 3 and 5, the concentric channels 4 and 6, the tangential channels 8, and the ring-shaped channel 7 in such a way that these channels become ducts and all leakage from the channels is avoided.

The delivery head is provided with a main channel 16 having bores 17 and 18 which empty into the recess 11 of the nozzle sleeve 1 from where a liquid (not shown) passes via the different channels of the nozzle sleeve 1 to bore 9 of the nozzle sleeve from where it is then sprayed out.

Figure 4:
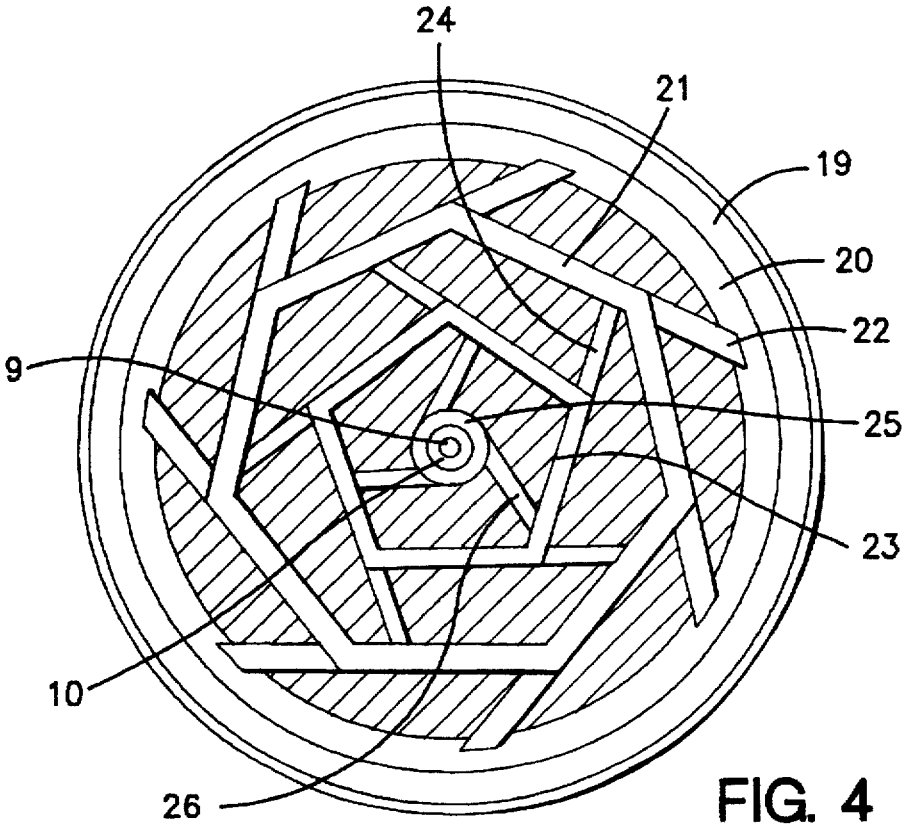

FIG. 4 shows an extremely advantageous embodiment of the spraying nozzle according to the invention. It shows the interior of a nozzle sleeve 19 having a recess 20. The nozzle sleeve 19 has a large concentric heptagonal channel 21 receiving at its corners, here counterclockwise, feeding channels 22 which are aligned with the sides of the large concentric channel 21. Downstream a small concentric pentagonal channel 23 is arranged which at its corners receives feeding channels 24 arriving clockwise from the large concentric channel 21 which are aligned with the sides of the small concentric channel 23. Feeding channels 26 issue, once more counterclockwise, from the small concentric channel and open tangentially into a central ring-shaped channel 25.

The depth of the nozzle sleeve is generally so selected that it will tightly cover the hollow space 14 of nozzle core 13 as well as the bore 15 of the delivery head 12 in such a way that leakage cannot arise there.

Figure 5:
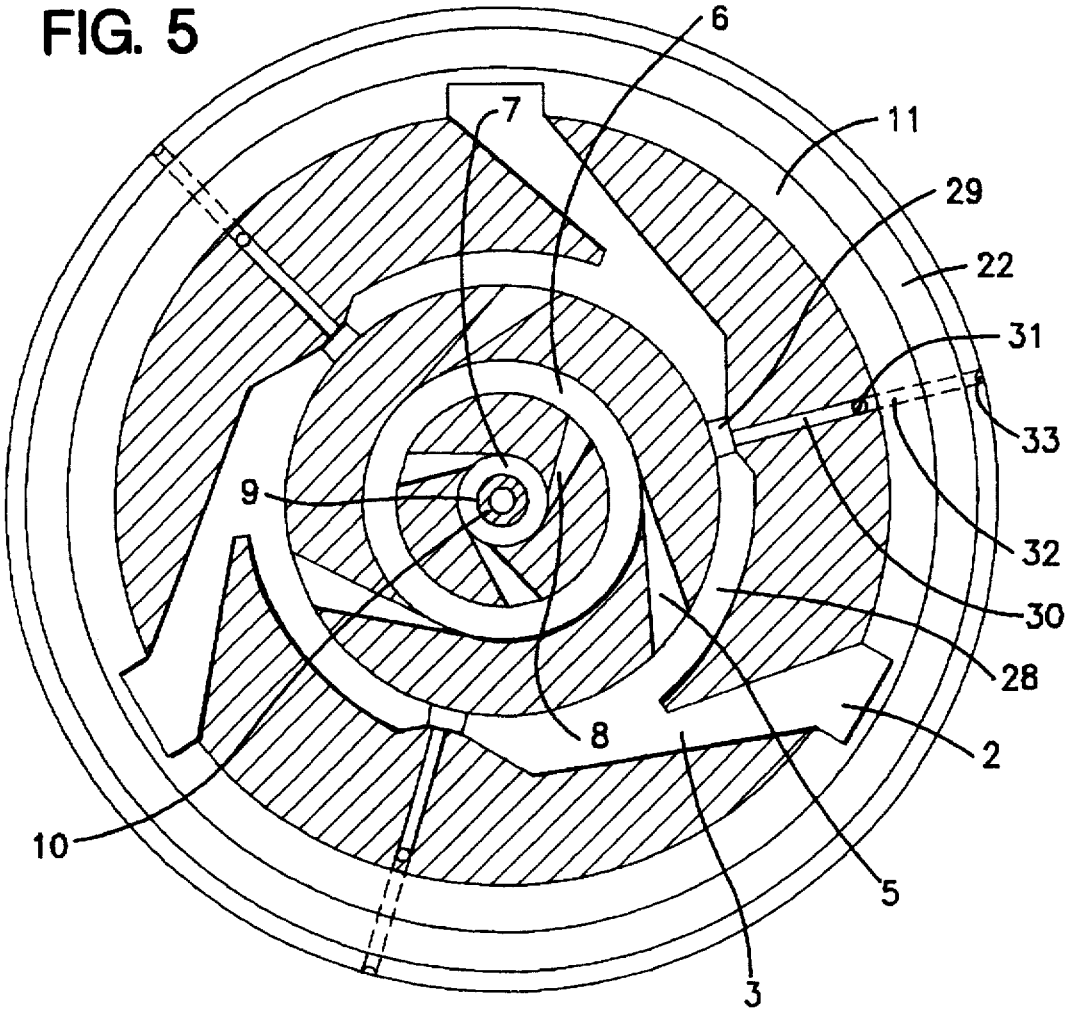
Figure 6:
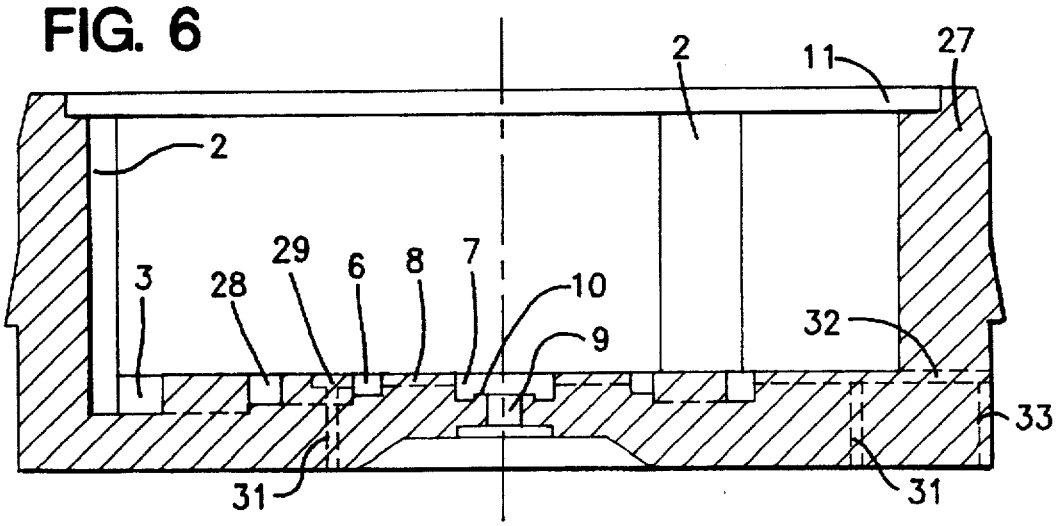

FIG. 5 shows an embodiment of the spraying nozzle according to the present invention where the nozzle sleeve 27 has a large concentric channel 28 provided with constrictions 29 into which air ducts 30 communicating with the outside air via bores 31 open perpendicularly. A Venturi effect is realized through these constrictions 29 when air is drawn in through the air ducts 30 and their bores 31 while a liquid passes these constrictions 29 in accelerated flow, this air is mixed with the liquid, and is then compressed in the liquid in the smaller downstream channels so that it will expand as if exploding when leaving the bore 9 and coming into contact with the atmospheric pressure, and shatter into even smaller droplets the liquid that has already been dispersed mechanically.

Rather than having the air ducts 30 open via bores 31 on the front face of the nozzle sleeve 27, these ducts can be extended axially as shown by the broken lines 32 and then connected with channels 33 running in a direction perpendicular to the ducts and communicating with the outside air.

The spraying nozzle of the present invention is of course not limited to its use in a delivery head 12. It can be used wherever a liquid which is subjected to variable pressure must be dispersed, as for instance in irrigation works and fire hoses, in which cases an independent nozzle core 13 is forced into a nozzle sleeve 1 and the ensemble is then mounted into a tubular element which can be attached to pipes or hoses.

In a simplified embodiment the spraying nozzle has a first set of feeding channels arranged in one direction of rotation and feeding a first concentric channel, and only one second set of feeding channels which issue from this concentric channel in the opposite direction of rotation and are connected with the delivery bore. In this embodiment only two sets of feeding channels exist. The second set of feeding channels which can be in the form of tangential channels can be connected to the bore, either directly or via a ring-shaped channel.

It may be advantageous in certain applications to provide the spraying nozzle with more than three concentric sets of feeding channels and more than two concentric channels.

I claim:

1. Spraying nozzle for regulating the rate of flow per unit of time comprising:

a nozzle sleeve (1, 19, 27);

a nozzle core (13) positioned within the nozzle sleeve (1, 19, 27);

supply channels (2) opening into first feeding channels (3, 22), said first feeding channels feeding a first concentric channel (4, 21);

second feeding channels (5, 24) connected to a bore (9) and extending from said first concentric channel part of the supply channels, the first feeding channels, the first concentric channel, and the second feeding channels being located substantially in one plane;

the first feeding channels being positioned on said plane inwardly from the supply channels and arranged in a first direction of rotation;

the first concentric channel being positioned on said plane inwardly of the first feeding channels and outwardly of the second feeding channels; and the second feeding channels being arranged on said plane in a second direction of rotation opposite to the first direction of rotation.

2. Spraying nozzle according to claim 1, wherein the second feeding channels (5, 24) are connected inwardly to at least a second concentric channel (6, 23), said at least a second concentric channel connected via at least third feeding channels (8, 26) to an inner, ring-shaped channel (7, 25), said inner, ring-shaped channel connected to the bore (9), said first and second feeding channels situated at opposite sides of a respective concentric channel extending in opposite directions at oblique angles to a radial direction.

3. Spraying nozzle according to claim 2, wherein the first and second feeding channels are arranged essentially in directions tangential to at least one of the ring-shaped channel and to the first and second concentric channels.

4. Spraying nozzle according to claim 1, wherein the nozzle core (13) is integral with a delivery head (12) and covered by the nozzle sleeve (1, 19, 27) while the nozzle core (13) has a hollow space (14) which is hermetically closed off from the outside air by the nozzle sleeve (1, 19, 27).

5. Spraying nozzle according to claim 4, wherein the delivery head (12) has a bore (15) radially aligned with respect to the hollow space (14) of the nozzle core (13).

6. Spraying nozzle according to claim 2, wherein the first concentric channel (21) is a heptagon while the second concentric channel (23) is a pentagon, that the first concentric channel (21) is supplied by seven first feeding channels (22) and the second concentric channel (23) is supplied by five second feeding channels, and that three third feeding channels which issue from the second concentric channel (23) are in the form of tangential channels (26) opening into the ring-shaped channel (25).

7. Spraying nozzle according to claim 6, wherein the first feeding channels (22) are aligned with the lateral walls of the first concentric channel (21) and the second feeding channels (24) are aligned with the lateral walls of the second concentric channel (23) while the tangential channels (26) form tangents to the outer wall of the ring-shaped channel (25).

8. Spraying nozzle according to claim 1, wherein the nozzle sleeve (1, 19, 27) has a recess (11, 20).

9. Spraying nozzle according to claim 1, wherein at least the first concentric channel (28) is provided with constrictions (29) while air ducts (30) communicating via bores (31) with the outside air are provided which are essentially perpendicular to these constrictions.

10. Spraying nozzle according to claim 9, wherein the air ducts (30) have an axial extension (32) communicating with the outside air via channels (33).

11. Spraying nozzle according to claim 1, wherein the nozzle core (13), independently of a delivery head (12), is forced as an autonomous element into the nozzle sleeve (1, 19, 27) and positioned with the latter in a tubular element.

12. Spraying nozzle for regulating the rate of flow per unit of time comprising:

a nozzle sleeve (1, 19, 27);

a nozzle core (13) positioned within the nozzle sleeve (1, 19, 27);

supply channels (2) opening into first feeding channels (3, 22), said first feeding channels arranged in one direction of rotation and feeding a first concentric channel (4, 21); and second feeding channels (5, 24) connected to a bore (9) and extending from said first concentric channel in an opposite direction of rotation wherein the nozzle core (13) is integral with a delivery head (12) and covered by the nozzle sleeve (1, 19, 27) while the nozzle core (13) has a hollow space (14) which is hermetically closed off from the outside air by the nozzle sleeve (1, 19, 27).

13. Spraying nozzle according to claim 12, wherein the delivery head (12) has a bore (15) radially aligned with respect to the hollow space (14) of the nozzle core (13).

14. Spraying nozzle for regulating the rate of flow per unit of time comprising:

a nozzle sleeve (1, 19, 27);

a nozzle core (13) positioned within the nozzle sleeve (1, 19, 27);

supply channels (2) opening into first feeding channels (3, 22), said first feeding channels arranged in one direction of rotation and feeding a first concentric channel (4, 21); and second feeding channels (5, 24) connected to a bore (9) and extending from said first concentric channel in an opposite direction of rotation wherein the first feeding channels (22) are aligned with the lateral walls of the first concentric channel (21) and the second feeding channels (24) are aligned with the lateral walls of the second concentric channel (23) while the tangential channels (26) form tangents to the outer wall of the ring-shaped channel (25).

15. Spraying nozzle for regulating the rate of flow per unit of time comprising:

a nozzle sleeve (1, 19, 27);

a nozzle core (13) positioned within the nozzle sleeve (1, 19, 27);

supply channels (2) opening into first feeding channels (3, 22), said first feeding channels arranged in one direction of rotation and feeding a first concentric channel (4, 21); and second feeding channels (5, 24) connected to a bore (9) and extending from said first concentric channel in an opposite direction of rotation wherein at least the first concentric channel (28) is provided with constrictions (29) while air ducts (30) communicating via bores (31) with the outside air are provided which are essentially perpendicular to these constrictions.

16. Spraying nozzle according to claim 15, wherein the air ducts (30) have an axial extension (32) communicating with the outside air via channels (33).

* * * * *